US010919321B2

(12) United States Patent
Kawarada et al.

(10) Patent No.: US 10,919,321 B2
(45) Date of Patent: Feb. 16, 2021

(54) DRYER AND PRINTER

(71) Applicants: Masaya Kawarada, Kanagawa (JP); Yasuhisa Katoh, Kanagawa (JP)

(72) Inventors: Masaya Kawarada, Kanagawa (JP); Yasuhisa Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/712,517

(22) Filed: Dec. 12, 2019

(65) Prior Publication Data

US 2020/0207119 A1 Jul. 2, 2020

(30) Foreign Application Priority Data

Dec. 26, 2018 (JP) ..... JP2018-243168
Feb. 5, 2019 (JP) ..... JP2019-018489

(51) Int. Cl.
*B41J 11/00* (2006.01)

(52) U.S. Cl.
CPC ..... *B41J 11/002* (2013.01)

(58) Field of Classification Search
CPC B41J 11/002; G03G 15/1695; G03G 15/2014
See application file for complete search history.

(56) References Cited

U.S. PATENT DOCUMENTS

| | | | | |
|---|---|---|---|---|
| 6,481,118 | B1 * | 11/2002 | De Vroome | F26B 13/10 101/424.1 |
| 9,908,342 | B1 | 3/2018 | Boland et al. | |
| 9,975,354 | B1 | 5/2018 | Boland et al. | |
| 10,759,171 | B2 * | 9/2020 | Tachibana | B41J 2/16517 |
| 2015/0174924 | A1 | 6/2015 | Fuchioka et al. | |
| 2016/0101635 | A1 | 4/2016 | Hoshino et al. | |
| 2017/0153059 | A1 | 6/2017 | Boland et al. | |
| 2017/0266990 | A1 | 9/2017 | Yoshinuma et al. | |
| 2017/0266991 | A1 | 9/2017 | Onodera et al. | |

FOREIGN PATENT DOCUMENTS

| | | |
|---|---|---|
| JP | 2017-109376 | 6/2017 |
| JP | 2018-066552 | 4/2018 |

* cited by examiner

*Primary Examiner* — Thinh H Nguyen
(74) *Attorney, Agent, or Firm* — Duft & Bornsen, PC

(57) ABSTRACT

A dryer includes a heater in a conveyance area in which an object is conveyed, the heater configured to heat the object on which a liquid is applied, a heated portion in an outer area outside the conveyance area, the heated portion connected to the heater, a partition wall partitioning the conveyance area and the outer area, an air supply unit in the conveyance area, the air supply unit configured to feed air to the object conveyed in the conveyance area, and a duct in the outer area, the duct connected to the air supply unit and configured to take in air around the heated portion.

12 Claims, 12 Drawing Sheets

DRYER AND PRINTER

CROSS-REFERENCE TO RELATED APPLICATIONS

This patent application is based on and claims priority pursuant to 35 U.S.C. § 119(a) to Japanese Patent Application No. 2018-243168, filed on Dec. 26, 2018, and Japanese Patent Application No. 2019-018489, filed on Feb. 5, 2019, in the Japan Patent Office, the entire disclosure of each of which is hereby incorporated by reference herein.

BACKGROUND

Technical Field

Aspects of the present disclosure relate to a dryer and a printer

Related Art

A dryer includes a cooling unit, a gas discharge unit, a gas introduction unit, supply unit, and an exhaust. The cooling unit feeds cooling air toward a vicinity of a heat source. The gas discharge unit discharges gas from the vicinity of the heat source. The gas introduction unit introduces the gas discharged from the gas discharge unit into the drying chamber. The supply unit supplies the gas introduced into the drying chamber to a vicinity of an outer peripheral surface of a heat roller. The exhaust exhausts the gas from a periphery of the heat roller outside a printer.

SUMMARY

In an aspect of this disclosure, a dryer is provided that includes a heater in a conveyance area in which an object is conveyed, the heater configured to heat the object on which a liquid is applied, a heated portion in an outer area outside the conveyance area, the heated portion connected to the heater, a partition wall partitioning the conveyance area and the outer area, an air supply unit in the conveyance area, the air supply unit configured to feed air to the object conveyed in the conveyance area, and a duct in the outer area, the duct connected to the air supply unit and configured to take in air around the heated portion.

BRIEF DESCRIPTION OF THE DRAWINGS

The aforementioned and other aspects, features, and advantages of the present disclosure will be better understood by reference to the following detailed description when considered in connection with the accompanying drawings, wherein:

FIG. 10 is a schematic cross-sectional view of a second variation of the dryer in

FIG. 2;

Figure 1:
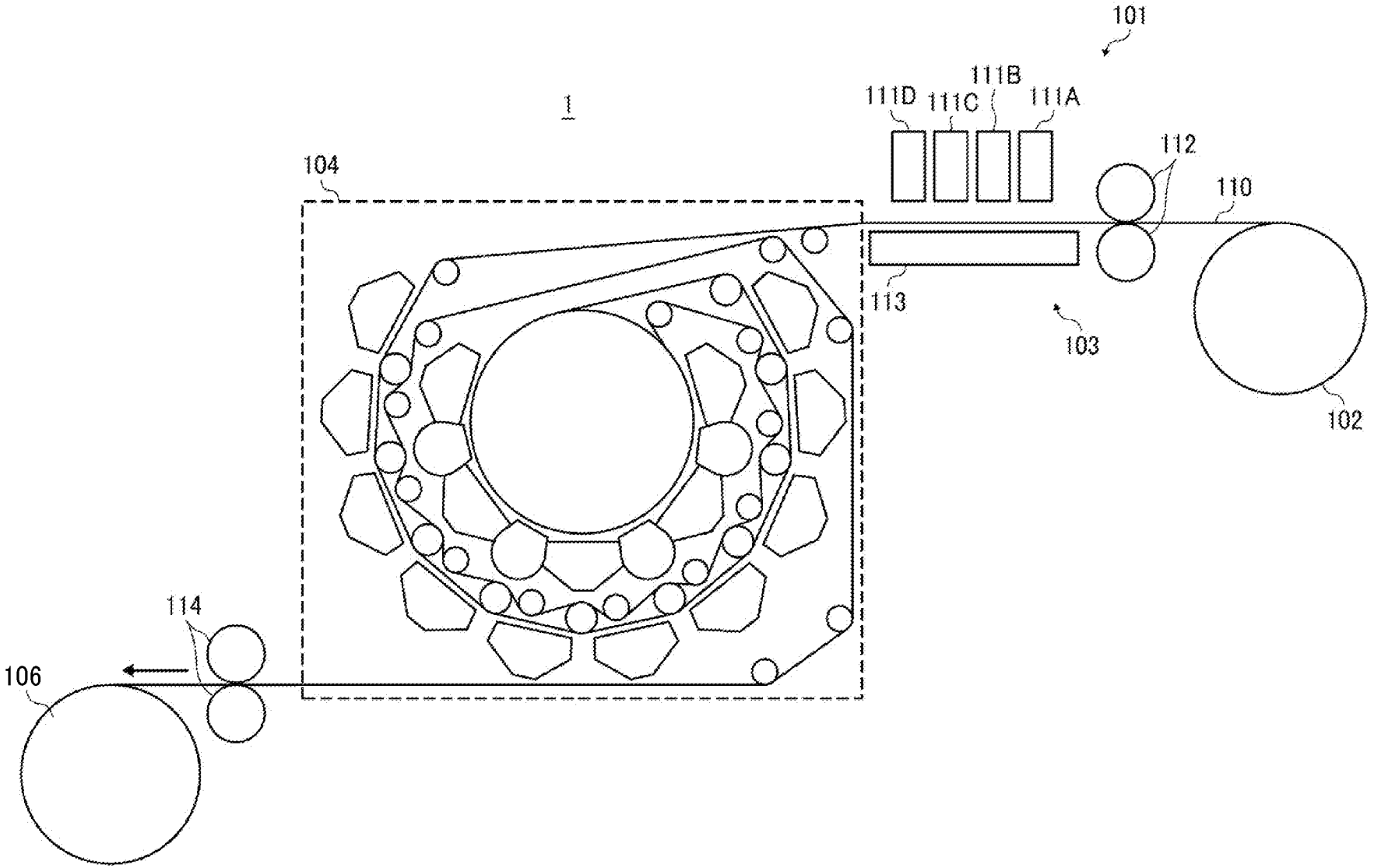
FIG. 1 is a schematic cross-sectional side view of a printer as an example of an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

FIG. 1 is a schematic cross-sectional side view of a printer 1 as an example of an embodiment of the present disclosure.

The printer 1 is an inkjet recording apparatus. The printer 1 includes a liquid application unit 101 including a liquid discharge head, that is a liquid applicator, to discharge and apply ink, that is a liquid of desired color, onto a continuous sheet 110 as a printing object (object to be dried). Hereinafter, the liquid discharge head is simply referred to as the "head". The "object to be dried" is also simply referred to as the "object".

The liquid application unit 101 includes, for example, full-line heads 111A, 111B, 111C, and 111D for four colors arranged from an upstream side in a conveyance direction of the continuous sheet 110. The heads 111A, 111B, 111C, and 111D apply liquids of black K, cyan C, magenta M, and yellow Y onto the continuous sheet 110, respectively. Note that the number and types of color are not limited to the above-described four colors of K, C, M, and Y and may be any other suitable number and types.

The continuous sheet 110 is fed from a root winding roller 102, is sent onto a conveyance guide 113 by conveyance rollers 112 of a conveyor 103, and is guided and conveyed (moved) by the conveyance rollers 112 and the conveyance guide 113. The conveyance guide 113 is disposed to face the liquid application unit 101.

The continuous sheet 110 onto which the liquid is applied by the liquid application unit 101 is sent by an ejection roller 114 through a dryer 104 as a dryer according to the present disclosure, and is wound around a winding roller 106. In the present embodiment, the object to be dried is the continuous sheet 110 onto which the liquid is applied by the liquid application unit 101. Further, a term of "drying" in the present disclosure, variations, and other embodiments described below is not limited to a state in which an amount of liquid such as moisture or solvent contained in the object to be dried is completely eliminated. The term "drying" in the present disclosure may also include a state in which an amount of liquid in the object to be dried is decreased from an amount of liquid in the object to be dried in an original state.

Figure 2:
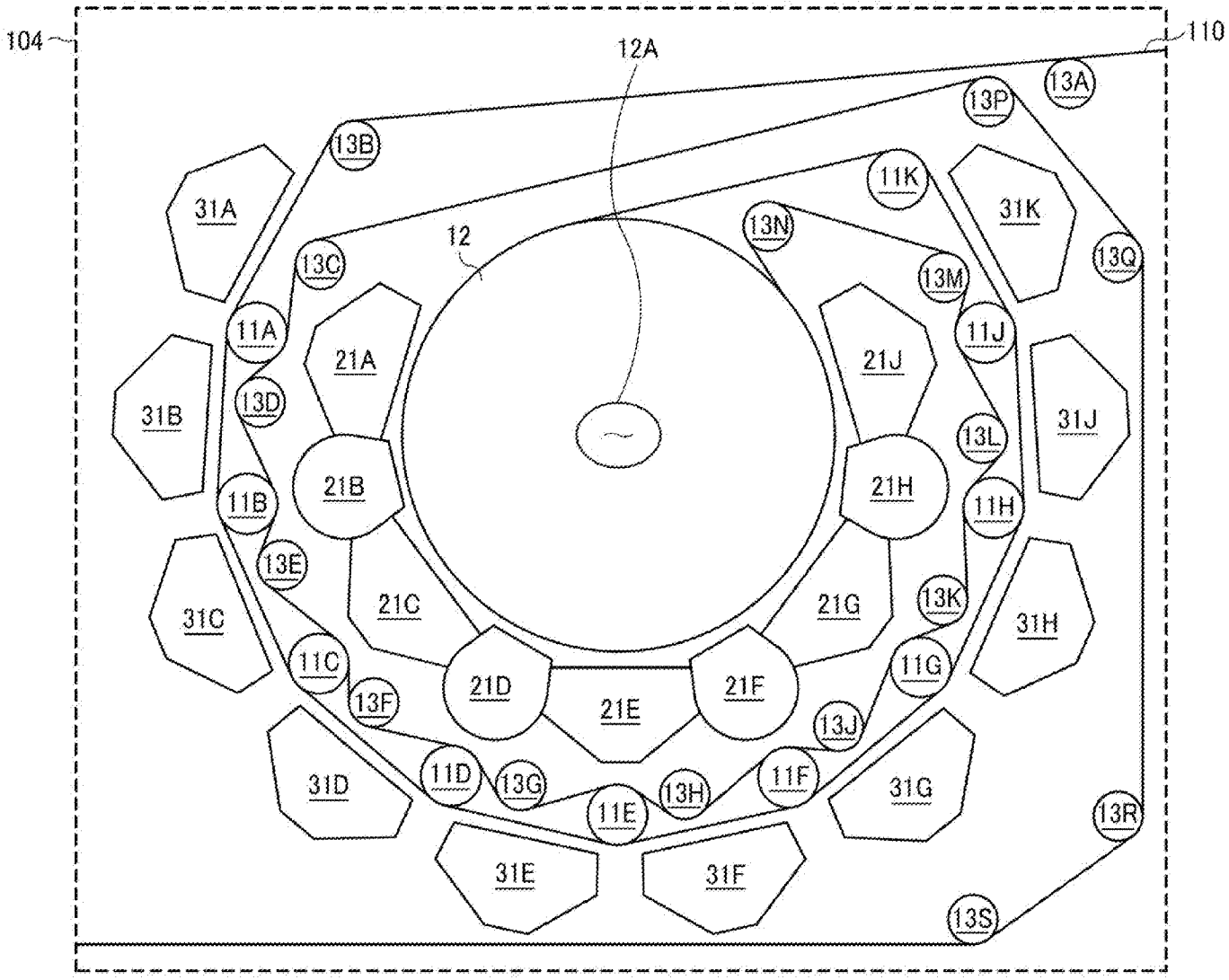
FIG. 2 is a cross-sectional side view of a dryer as an example of an embodiment of the present disclosure.

FIG. 2 is a cross-sectional side view of the dryer 104 as an embodiment of the present disclosure.

The dryer 104 includes a heating drum 12 and heating rollers 11. The heating drum 12 is an example of a heater that contacts and heats the continuous sheet 110. The heating rollers 11 (11A to 11K) are an example of a second heater that contact and heat the continuous sheet 110. The heating rollers 11 are arranged outside the heating drum 12. The heating drum 12 includes a heat source 12A such as a halogen heater inside the heating drum 12. Similarly, the heating rollers 11 also include a heat source such as a halogen heater inside the heating rollers 11. The heating drum 12 and the heating rollers 11 are rotating bodies configured to be rotatable. The heating drum 12 is rotatable in a counter clockwise direction by a driving force of a motor. The heating drum 12 applies a conveyance force to the continuous sheet 110 to convey the continuous sheet 110. The heating rollers 11 are driven to rotate along with the conveyance of the continuous sheet 110.

The heating rollers 11 includes a curved contact surface to contact and heat the continuous sheet 110. The heating drum 12 also includes a curved contact surface to contact and heat the continuous sheet 110. The heating drum 12 has a larger outer diameter and a larger heating amount than the heating rollers 11 (11A to 11K).

The dryer 104 further includes a guide roller 13N and guide rollers 13M to 13C (pressing rollers). The guide roller 13N is arranged downstream of the heating drum 12 and functions as a contact guide to guide the continuous sheet 110 to the heating roller 11J. The guide rollers 13M to 13C are contact guide to guide the continuous sheet 110 guided by the guide roller 13N to come into contact with the heating rollers 11J to 11A.

Here, the plurality of heating rollers 11A to 11K is arranged in a substantially arc shape around the heating drum 12 to surround the heating drum 12. The diameters of the plurality of heating rollers 11A to 11K may be the same or different from each other. Further, the guide rollers 13D to 13L are disposed between the adjacent heating rollers 11.

The plurality of heating rollers 11, the heating drum 12, and the plurality of guide rollers 13 constitute a heating conveyance path (conveyance path) to heat the continuous sheet 110. The continuous sheet 110 is conveyed while contacting an outer peripheral side of a contact surface of the plurality of heating rollers 11 arranged in the circular arc shape on the upstream of the heating drum 12. Then, the guide rollers 13 conveys the continuous sheet 110 passed through the heating drum 12 while the continuous sheet 110 contacts again an inner peripheral side of a contact surface of the plurality of heating rollers 11. Thus, the continuous sheet 110 is conveyed in contact with the inner peripheral side and the outer peripheral side of the contact surfaces of the plurality of heating rollers 11 so that the continuous sheet 110 surrounds the heating drum 12.

The dryer 104 includes air supply units 31 (31A to 31K) that feed air toward the continuous sheet 110 conveyed from the guide roller 13B while contacting an outer peripheral surface of the plurality of heating rollers 11.

The air supply units 31 (31A to 31K) are arranged on the outer peripheral side of an array of the plurality of heating rollers 11. The air supply units 31 (31A to 31K) blow an airflow to a liquid application surface of the continuous sheet 110. The plurality of air supply units 31A to 31K is arranged so as to surround the heating drum 12. Further, the plurality of air supply units 31B to 31K is arranged downstream of the plurality of heating rollers 11A to 11J in the conveyance direction. That is, the plurality of air supply units 31B to 31K feeds air toward a region of the continuous sheet 110 that is heated in contact with the contact surfaces on the outer peripheral side of the plurality of heating rollers 11A to 11J. That is, the plurality of air supply units 31 is disposed at a position between two adjacent heating rollers 11. For example, the air supply unit 31B is arranged to feed air toward the continuous sheet 110 passing between the heating roller 11A and the heating roller 11B.

The dryer 104 includes second air-supply units 21 (21A to 21J) that feed air toward the continuous sheet 110 in a position directly facing the heating drum 12. The second air-supply units 21 (21A to 21J) are arranged around an outer periphery of the heating drum 12 and blow an airflow to a liquid application surface of the continuous sheet 110. That is, the second air-supply units 21 (21A to 21J) feed air toward a region of the continuous sheet 110 that is heated in contact with the heating drum 12.

In FIG. 2, the air supply units 31 (31A to 31K) are arranged to feed air toward the liquid application surface of the continuous sheet 110 on the upstream of the heating drum 12 in the conveyance direction of the continuous sheet 110. The dryer 104 according to the present embodiment may also include the air supply units 31 that feeds air toward the liquid application surface of the continuous sheet 110 on the downstream of the heating drum 12 in the conveyance direction of the continuous sheet 110.

Figure 3:
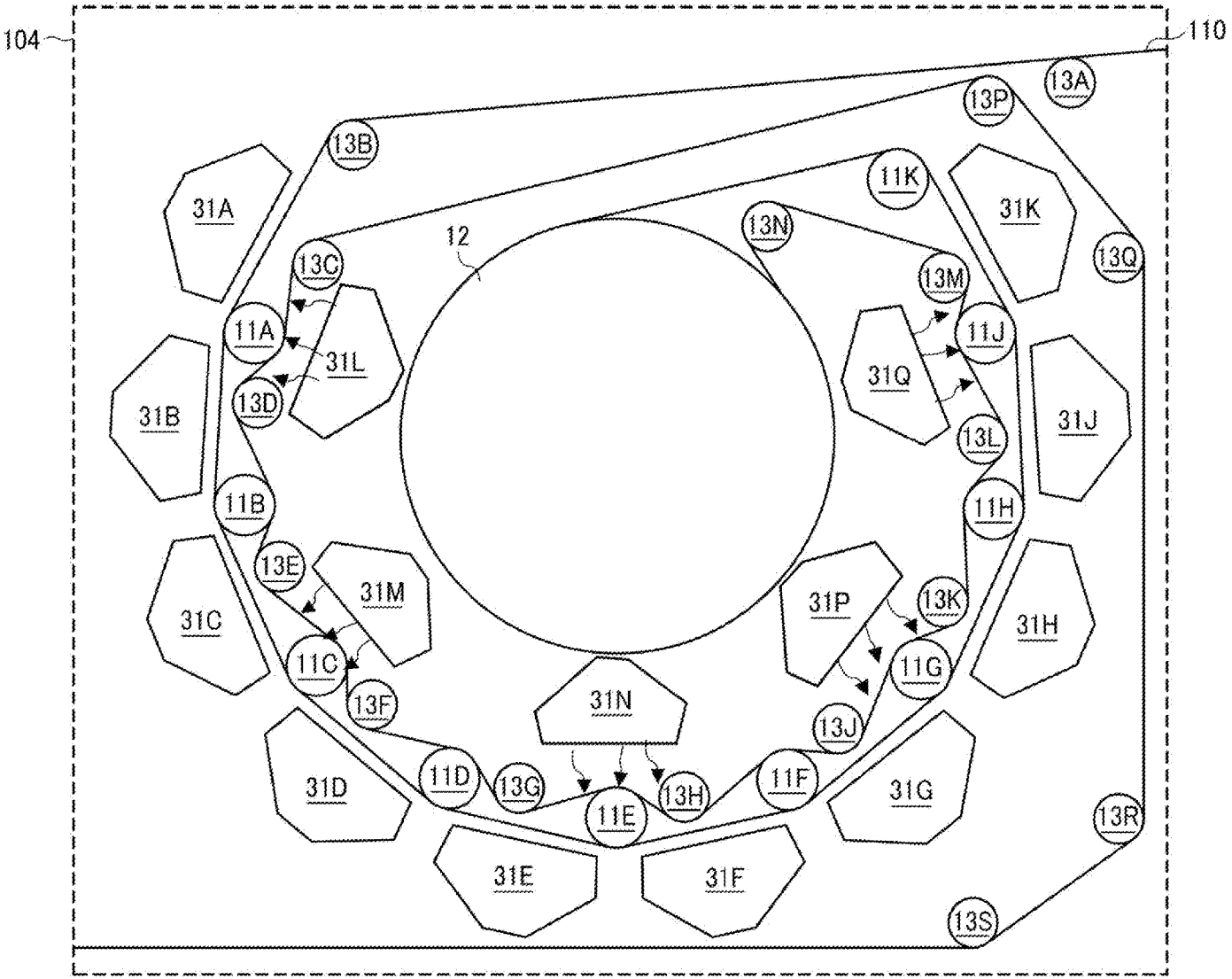
FIG. 3 is a schematic side view of a variation of the dryer in FIG. 2.

FIG. 3 is a schematic side view of a variation of the dryer 104 in FIG. 2. The dryer 104 in FIG. 3 has a configuration different from the dryer 104 in FIG. 2. For example, the dryer 104 in FIG. 3 includes air supply units 31 (31L, 31M, 31N, 31P, and 31Q) arranged to feed air toward the liquid application surface of the continuous sheet 110 on the downstream of the heating drum 12 in the conveyance direction of the continuous sheet 110.

Further, the dryer 104 includes the guide rollers 13A and 13B that guide the continuous sheet 110 into the dryer 104, the guide rollers 13N that guides the continuous sheet 110 that has passed through the heating drum 12 to the guide roller 13M, and a plurality of guide rollers 13 (13P to 13S) to guide the continuous sheet 110 that has passed through the guide roller 13C out of the dryer 104.

The dryer 104 thus configured brings the outer peripheral side of the heating roller 11 into contact with a back surface (opposite surface) of the continuous sheet 110 opposite to the liquid application surface while blowing the airflow (air) onto the liquid application surface of the continuous sheet 110 by the air supply units 31A to 31K to dry the liquid application surface of the continuous sheet 110.

Then, the dryer 104 brings the back surface (opposite surface) the continuous sheet 110 opposite to the liquid application surface into contact with the heating drum 12 arranged inside the plurality of heating rollers 11 to heat the continuous sheet 110.

Then, the dryer 104 brings the guide roller 13 into contact with the liquid application surface of the continuous sheet 110 while brings again the heating rollers 11J to 11A into contact with the back surface (opposite surface) of the continuous sheet 110 to heat the continuous sheet 110. While the heating rollers 11J to 11A heat the continuous sheet 110, the air supply units 31Q to 31L blow an airflow (air) onto the liquid application surface of the continuous sheet 110 to dry the liquid applied onto the continuous sheet 110.

Figure 4:
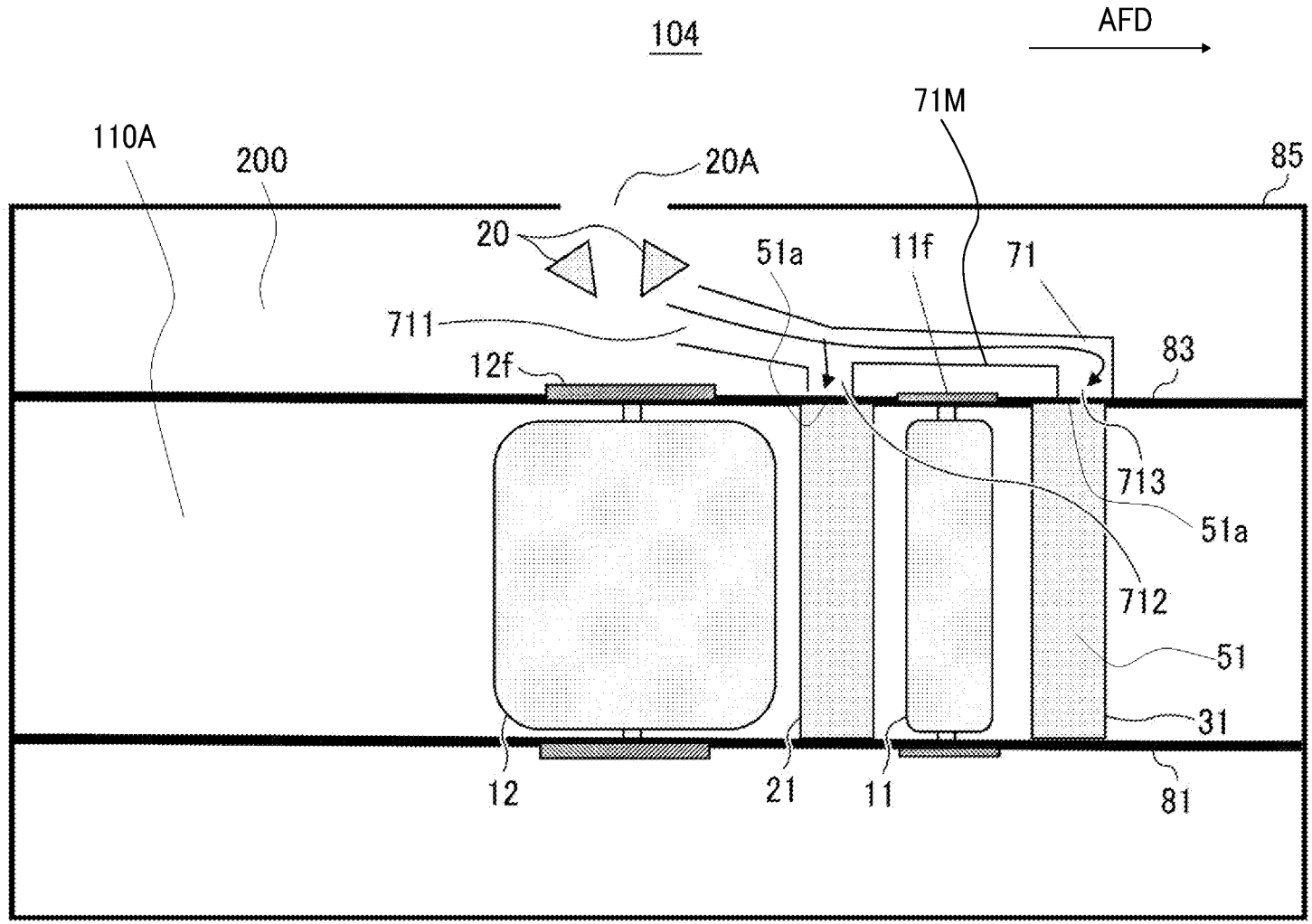
FIG. 4 is a schematic plan view of an air supply unit in the dryer illustrated in FIGS. 2 and 3.

FIG. 4 is a schematic plan view of the air supply unit 31 in the dryer 104 illustrated in FIGS. 2 and 3.

The dryer 104 includes a front-side plate 81, a rear-side plate 83, and a housing 85. The rear-side plate 83 separates a conveyance area 110A of the continuous sheet 110 from an outer area 200 of a heating roller drive mechanism in which a drive mechanism of the heating rollers 11 is arranged. Hereinafter, the outer area 200 is also referred to as the "arrangement area". The rear-side plate 83 is also referred to as the "partition wall" or "frame" to separate the conveyance area 110A from the outer area 200 of the heating rollers 11 and the heating drum 12. Thus, the rear-side plate 83 (partition wall) partitions the conveyance area 110A and the outer area 200.

The heating drum 12, the heating rollers 11, the air supply units 31, and the second air-supply units 21 are arranged in the conveyance area 110A of the continuous sheet 110 between the front-side plate 81 and the rear-side plate 83, that is the conveyance area 110A of the continuous sheet 110. The dryer 104 further includes a drum flange 12*f* and a roller flange 11*f* in the outer area 200 outside the front-side plate 81 and the rear-side plate 83. The drum flange 12*f* rotatably supports the heating drum 12. The drum flange 12*f* is connected to the heating drum 12 so that heat generated from the heating drum 12 is transferred to the drum flange 12*f*.

Similarly, the roller flange 11*f* rotatably supports the heating rollers 11. The roller flange 11*f* is connected to the heating roller 11 so that heat generated from the heating roller 11 is transferred to the roller flange 11*f*.

Thus, each of the drum flange 12*f* and the roller flange 11*f* is an example of a heated portion connected to the heater (heating drum 12 and heating rollers 11).

The dryer 104 includes a fan 20 as an example of a blower that feeds air to the drum flange 12*f* of the heating drum 12 and a duct 71 that feeds the air around the drum flange 12*f* to the air supply unit 31. The fan 20 and the duct 71 are arranged in the outer area 200 between the rear-side plate 83 and the housing 85.

The fan 20 and the duct 71 may also be arranged in the outer area 200 between the front-side plate 81 and the housing 85.

The dryer 104 includes a vent port 20A through which the fan 20 takes in air outside the housing 85. The vent port 20A is formed at a position outside the fan 20 in the housing 85. The fan 20 takes in the air at normal temperature outside the housing 85 from the vent port 20A and feeds the air toward the drum flange 12*f*. Thus, the air fed from the fan 20 cools the drum flange 12*f* heated to a high temperature by the heat source of the heating drum 12, and overheating of the drum flange 12*f* is thus suppressed.

The duct 71 includes a suction port 711, an air supply port 713, and a second air-supply port 712. The suction port 711 takes in air around the drum flange 12*f*. The air supply port 713 is connected to the air supply unit 31. The second air-supply port 712 is connected to an intake port 51*a* of the second air-supply unit 21. The air taken in from the suction port 711 is distributed and fed to the air supply unit 31 and the second air-supply unit 21.

Since a suction side (upstream side) of the fan 20 becomes a negative pressure and a feeding side (downstream side) of the fan 20 becomes a positive pressure, the air at normal temperature taken in from the vent port 20A is sucked by the fan 20, is fed toward the drum flange 12*f* and hit the drum flange 12*f* to be heated by the drum flange 12*f*, and is taken in from the suction port 711. Thus, the dryer 104 can prevent the air at room temperature taken in from the vent port 20A to be directly taken in from the suction port 711.

The air supply unit 31 is disposed downstream of the second air-supply unit 21 in an airflow direction indicated by arrow "AFD" in FIG. 4. A portion of the duct 71 between the second air-supply port 712 and the air supply port 713 is arranged adjacent to the roller flange 11*f* of the heating roller 11. The second air-supply port 712 is connected to the second air-supply unit 21. The air supply port 713 is connected to an intake port 51*a* of the air supply unit 31.

Since the roller flange 11*f* is heated by the heat source of the heating roller 11 to high temperature, the air existed between the rear-side plate 83 and the housing 85 is also heated by heat transferred from the roller flange 11*f*. Thus, the portion of the duct 71 adjacent to the roller flange 11*f* is also heated, and the air passing through the duct 71 is heated and kept warm.

The fan 20, the vent port 20A, the duct 71, the air supply unit 31, and the second air-supply unit 21 configure the air supply device of the dryer 104 according to the present embodiment.

The dryer 104 includes the air supply unit 31 and the duct 71. The air supply unit 31 feeds the air toward the continuous sheet 110 positioned upstream or downstream of the heating drum 12 in the conveyance direction of the continuous sheet 110. The duct 71 takes in the air around the drum flange 12*f* of the heating drum 12 to be fed to the air supply unit 31 through the duct 71.

Thus, the dryer 104 can blow warm air around the drum flange 12*f* to the liquid application surface of the continuous sheet 110 positioned upstream or downstream of the heating drum 12 in the conveyance direction. Thus, the dryer 104 can promote drying of the continuous sheet 110 positioned upstream or downstream of the heating drum 12 in the conveyance direction of the continuous sheet 110 and can improve drying efficiency of the dryer 104.

The continuous sheet 110 in contact with the heating drum 12 is sufficiently heated by the heating drum 12. Thus, drying efficiency of drying the continuous sheet 110 by blowing the warm air from the air supply unit 31 toward the continuous sheet 110 not heated by the heating drum 12 is higher than drying efficiency by blowing the warm air from the air supply unit 31 toward the continuous sheet 110 heated by the heating drum 12. Further, vapor floats from the heated continuous sheet 110, and a humid airflow exists in the conveyance area 110A.

Conversely, since the rear-side plate 83 partitions the outer area 200 and the conveyance area 110A, the humid airflow in the conveyance area 110A is unlikely to float into the outer area 200. Thus, the airflow passing through the duct 71 has a humidity lower than a humidity of the airflow in the conveyance area 110A. Therefore, the dryer 104 can further improve drying property of the continuous sheet 110.

Further, the heat of the drum flange 12*f* (also referred to as a heat body) in the conveyance area 110A is mixed with the airflow in the duct 71. Thus, the dryer 104 can make the temperature of the air blown onto the continuous sheet 110 to be higher than the temperature outside the dryer 104.

Thus, the dryer 104 can prevent dew that is easily generated by blowing a cold airflow outside the dryer 104 onto the continuous sheet 110.

The dryer 104 includes the fan 20 that feeds air to the heating drum 12 (drum flange 12*f*), and the duct 71 feeds to the air supply unit 31 the air that is fed from the fan 20 to the drum flange 12*f*. Thus, the dryer 104 can effectively use the warm air around the drum flange 12*f* to improve the drying efficiency while cooling the drum flange 12*f*.

Further, the duct 71 distributes the air around a heated portion of the drum flange 12*f* to the air supply unit 31 and the second air-supply unit 21. Thus, the dryer 104 blows the warm air around the drum flange 12*f* to the continuous sheet 110 in contact with the heating drum 12 from the second air-supply unit 21 to promote drying of the continuous sheet 110. Thus, the duct 71 and the second air-supply unit 21 increase an area of the continuous sheet 110 that receives the warm air and increase the drying efficiency compared to a configuration in which the warm air is blown only to the continuous sheet 110 positioned on upstream or downstream of the heating drum 12 in the conveyance direction.

As illustrated in FIG. 3, the air supply unit 31 feeds the air to the continuous sheet 110 heated by the heating roller 11. Thus, the dryer 104 can further improve drying of the continuous sheet 110 positioned upstream or downstream of the heating drum 12 in the conveyance direction of the continuous sheet 110.

As illustrated in FIG. 4, the duct 71 includes a portion 71M between the second air-supply unit 21 and the air supply unit 31. The portion 71M faces the roller flange 11*f* and is adjacent to the roller flange 11*f* of the heating roller 11. Thus, the air fed from the duct 71 to the air supply unit 31 is air that is kept warm by the heat transferred from the roller flange 11*f*. Thus, the dryer 104 can prevent temperature drop of the air fed from the air supply unit 31. Thus, the dryer 104 can improve drying of the continuous sheet 110 positioned upstream or downstream of the heating drum 12 in the conveyance direction of the continuous sheet 110.

Thus, the dryer 104 includes a heater (heating drum 12 and heating rollers 11) in a conveyance area 110A in which an object to be dried (conveyance sheet 110) is conveyed, the heater (heating drum 12 and heating rollers 11) to heat the object to be dried (conveyance sheet 110) on which a liquid is applied, a heated portion (drum flange 12*f*) in an outer area 200 outside the conveyance area 110A, a partition wall (rear-side plate 83) to partition the conveyance area 110A and the outer area 200, the heated portion (drum flange 12*f*) connected to the heater (heating drum 12 and heating rollers 11) through the partition wall (rear-side plate 83), an air supply unit 31 in the conveyance area 110A, the air supply unit 31 to feed air to the object to be dried (continuous sheet 110) conveyed in the conveyance area 110A, and a duct 71 in the outer area 200, the duct 71 connected to the air supply unit 31 to feed, to the air supply unit 31, air around the heated portion (drum flange 12*f*).

Figure 5:
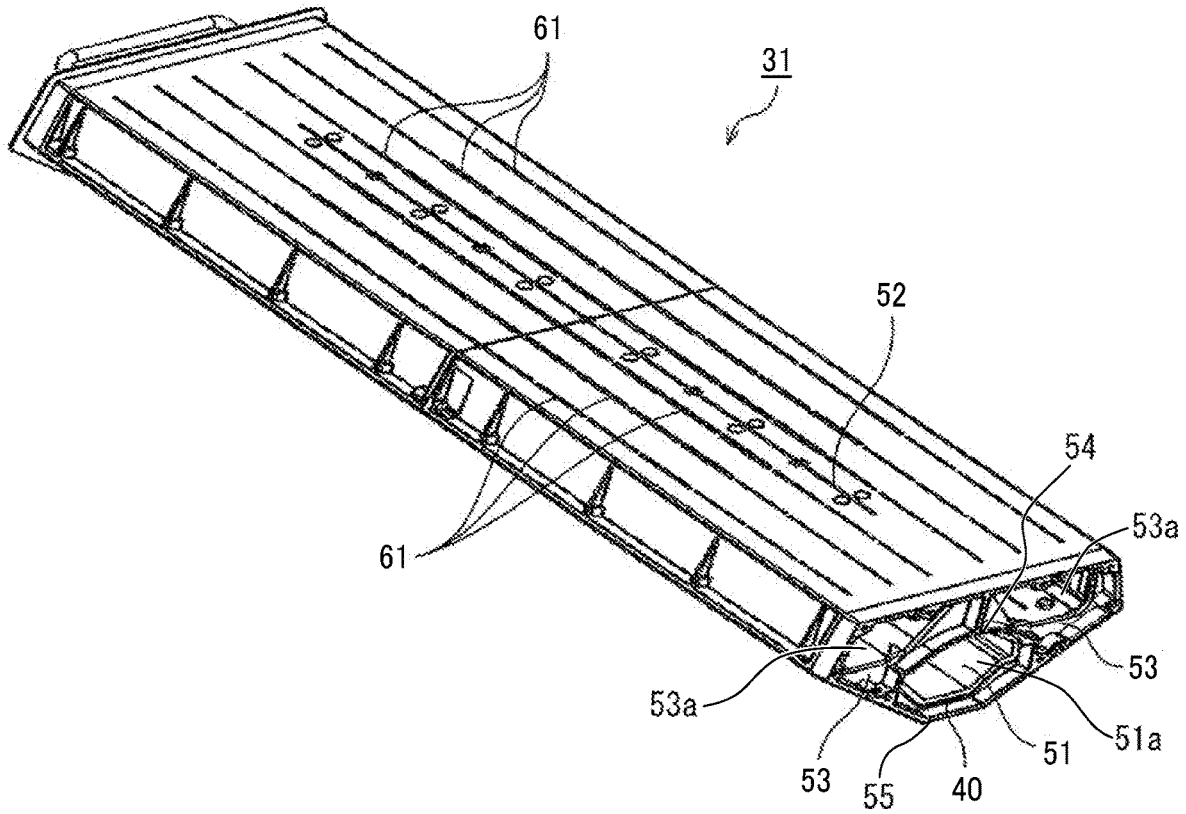
FIG. 5 is a schematic perspective view of the air supply unit in the dryer illustrated in FIGS. 2 and 3.

FIG. 5 is a schematic perspective view of the air supply unit 31 in the dryer 104 illustrated in FIGS. 2 and 3.

The air supply unit 31 includes an air supply chamber 51, a nozzle 52, and exhaust chambers 53. The air supply chamber 51 is connected to the air supply port 713 (see FIG. 4) of the duct 71 and serves as a channel of airflow. The nozzle 52 is a blowout port that blows the air communicating with the air supply chamber 51 outside the air supply unit 31 such as the conveyance area 110A (see FIG. 4). The exhaust chambers 53 are positioned at both sides of the air supply chamber 51 in a transversal direction of the air supply chamber 51. The air supply chamber 51 and the exhaust chambers 53 are formed in a longitudinal direction of the air supply unit 31. Each of the air supply chamber 51 and the exhaust chambers 53 has a separate space.

The air supply unit 31 includes a heat insulation member 40 to reduce heat transfer on an inner wall of the air supply chamber 51.

Figure 8:
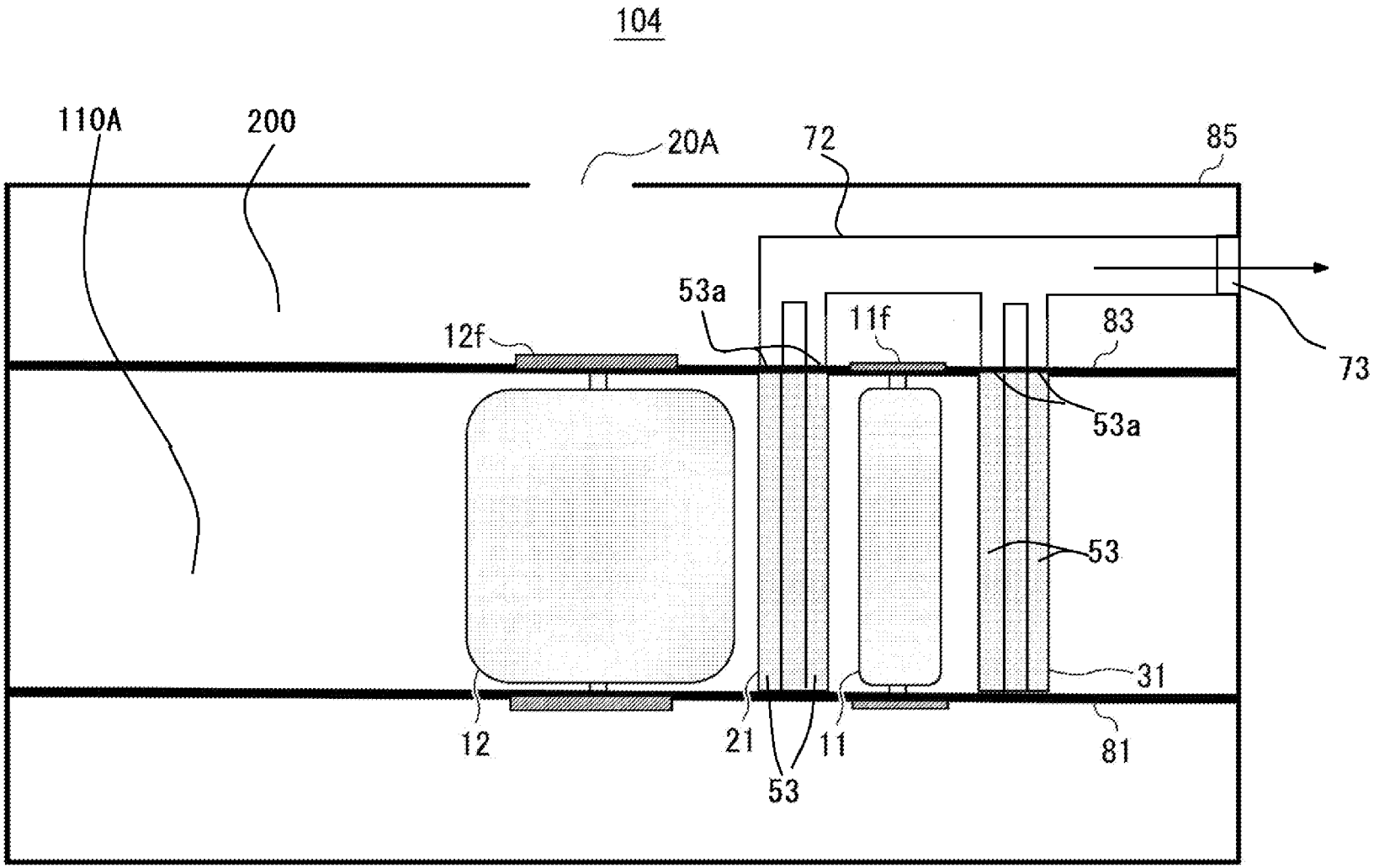
FIG. 8 is a schematic plan view of an exhaust chamber in the air supply unit in the dryer illustrated in FIGS. 2 and 3.

The air supply unit 31 includes exhaust holes 61 in the exhaust chamber 53. The exhaust chamber 53 is connected to an exhaust fan 73 via an exhaust duct 72 as illustrated in FIG. 8. The air supply unit 31 is arranged in the dryer 104 so that the nozzle 52 and the exhaust holes 61 face the liquid application surface of the continuous sheet 110 as illustrated in FIGS. 2 and 4.

The air supply unit 31 guides the warm air around the drum flange 12*f* to the nozzle 52 through the duct 71 and blows out the air from the nozzle 52. The nozzle 52 is formed in a center in a transverse direction of the air supply unit 31 and is formed along a longitudinal direction of the air supply unit 31.

The exhaust chambers 53 communicate with the exhaust holes 61. The exhaust holes 61 are formed in three rows on each side of the nozzles 52 in the transverse direction of the air supply unit 31. The exhaust holes 61 draw the airflow that is blown onto the continuous sheet 110 from the nozzles 52 and is bounced back from the continuous sheet 110 to the air supply unit 31. The exhaust chambers 53 collect warm air containing moisture and solvent generated by heating the continuous sheet 110 with the heating drum 12 and the heating rollers 11 from the exhaust holes 61. Thus, the warm air is collected to the exhaust chambers 53 and is flown through the exhaust chambers 53. The warm air around the drum flange 12*f* also flows through the air supply chamber 51. Thus, the air supply unit 31 can reduce dew generated by the vapor contacting the air supply unit 31 and adhering to an outer peripheral surface of the air supply unit 31. The vapor of the solvent contained in the liquid is generated when the continuous sheet 110 is heated by the heating drum 12 or the heating rollers 11 or the like.

The air supply unit 31 is made of a material having a thermal conductivity of 1 W/(m·K) or less. As a material having a thermal conductivity of 1 W/(m·K) or less, a resin material such as engineering plastics such as polyacetal and polyamide may be used, for example. Thus, the air supply unit 31 reduces dew generated by the warm air contacting an inner peripheral surface or an outer peripheral surface of the air supply chamber 51. The warm air containing moisture or solvent is generated by heating the continuous sheet 110 with the heating drum 12 and the heating rollers 11.

Thus, the air supply unit 31 can prevent the dew to be dropped and adhered on the continuous sheet 110 that may soil the printed image and deteriorate image quality of the printed image on the continuous sheet 110.

It is not necessarily to form an entire of the air supply unit 31 with a material having a thermal conductivity of 1 W/(m·K) or less. For example, only a wall 54 and a wall 55 of the air supply unit 31 may be formed of the material having a thermal conductivity of 1 W/(m·K) or less. The wall 54 partitions the air supply chamber 51 and the exhaust chambers 53. The air supply chamber 51 contacts outside air (airflow in the conveyance area 110A) on the wall 55. Alternatively, a sheet formed of a material having low thermal conductivity such as foam or rubber may be attached to an outer wall surface of the air supply unit 31 formed of metal.

Figure 6:
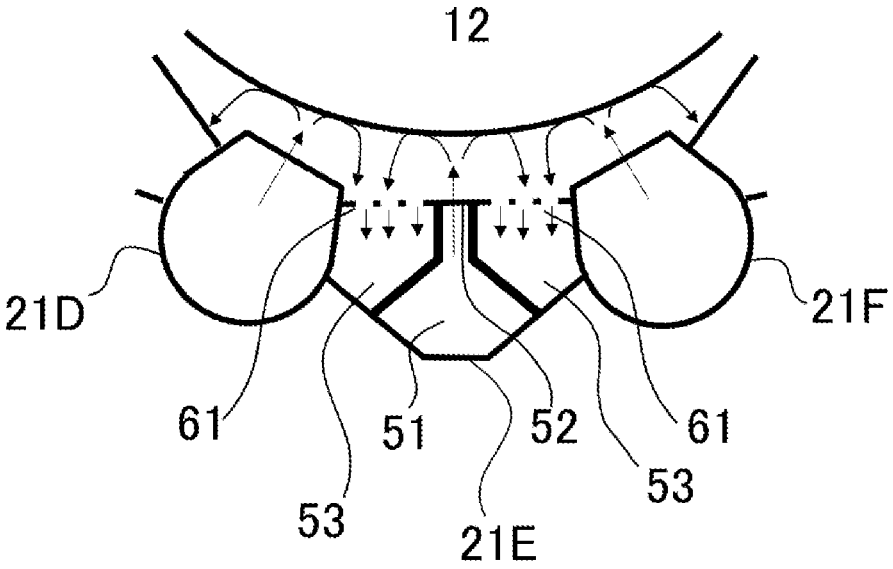
FIG. 6 is a schematic side view of an airflow of the air supply unit in FIG. 5.
Figure 7:
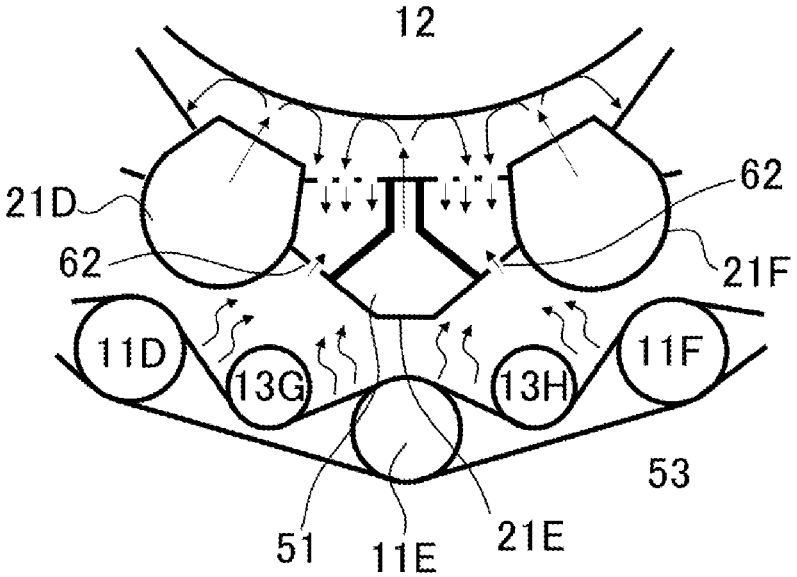
FIG. 7 is a schematic side view of an airflow of the air supply unit in FIG. 5.

The configuration of the air supply unit 31 illustrated in FIG. 5 may also be applied to the second air-supply units 21A, 21C, 21E, 21G, and 21J in FIG. 2. FIG. 6 is an enlarged cross-sectional view of the portion of the dryer 104 in FIG. 2. As illustrated in FIG. 6, the second air-supply unit 21E blows air from the nozzle 52 toward the continuous sheet 110, and draws the airflow bounced back from the continuous sheet 110 from the exhaust holes 61. The second air-supply units 21D and 21F adjacent to the second air-supply unit 21E can blow air from the nozzles 52 toward the continuous sheet 110. Thus, the air (airflow) is blown from the second air-supply units 21D and 21F onto the continuous sheet 110, is bounced back to the second air-supply units 21D, 21E, and 21F from the continuous sheet 110, and is drawn into the second air-supply units 21E from the exhaust holes 61 of the second air-supply units 21E. The vapor around the heating drum 12 is circulated by the airflow blown from the nozzles 52 of the second air-supply unit 21E and drawn into the exhaust holes 61. Thus, drying property of the dryer 104 is further improved. FIG. 7 is another enlarged cross-sectional view of the portion of the dryer 104 in FIG. 2. As illustrated in FIGS. 2 and 7, the second air-supply units 21A, 21C, 21E, 21G, and 21J may include another exhaust holes 62 on an opposite side of the exhaust holes 61 in addition to the exhaust holes 61 facing the heating drum 12. The vapor generated from the continuous sheet 110 that contacts the contact surface on the inner peripheral side of the heating roller 11 is taken into the exhaust chamber 53 from the exhaust holes 62 of the second air-supply unit 21E disposed above the continuous sheet 110. Thus, the dryer 104 can efficiently collects vapor in the dryer 104. Thus, drying property of the dryer 104 is further improved. Here, the vapor taken in from the exhaust holes 61 and 62 may be taken into the common exhaust chamber 53 or may be taken into separate exhaust chambers.

The dryer 104 includes an exhaust duct 72 and an exhaust fan 73 illustrated in FIG. 8 in addition to the duct 71 illustrated in FIG. 4.

The exhaust duct 72 is connected to an exhaust port 53*a* of the air supply unit 31 and an exhaust port 53*a* of the second air-supply unit 21. The air collected from the exhaust holes 61 of the air supply unit 31 flows through the exhaust chamber 53, travels to the exhaust duct 72, is sucked by the exhaust fan 73, and is exhausted outside the dryer 104 from the exhaust duct 72.

Therefore, the air collected from the exhaust holes 61 of the air supply unit 31 is not exhausted (discharged) to the outer area 200. Thus, the dryer 104 can prevent the air collected from the exhaust holes 61 to be mixing with the air in the duct 71 illustrated in FIG. 4. Thus, the air blown from the nozzles 52 of the air supply unit 31 onto the continuous sheet 110 does not include a humid airflow floating in the conveyance area 110A. Thus, drying property of the dryer 104 to dry the continuous sheet 110 is further improved.

Thus, the exhaust duct 72 collects air from the air supply unit 31 and exhausts collected air outside the dryer 104.

Figure 9:
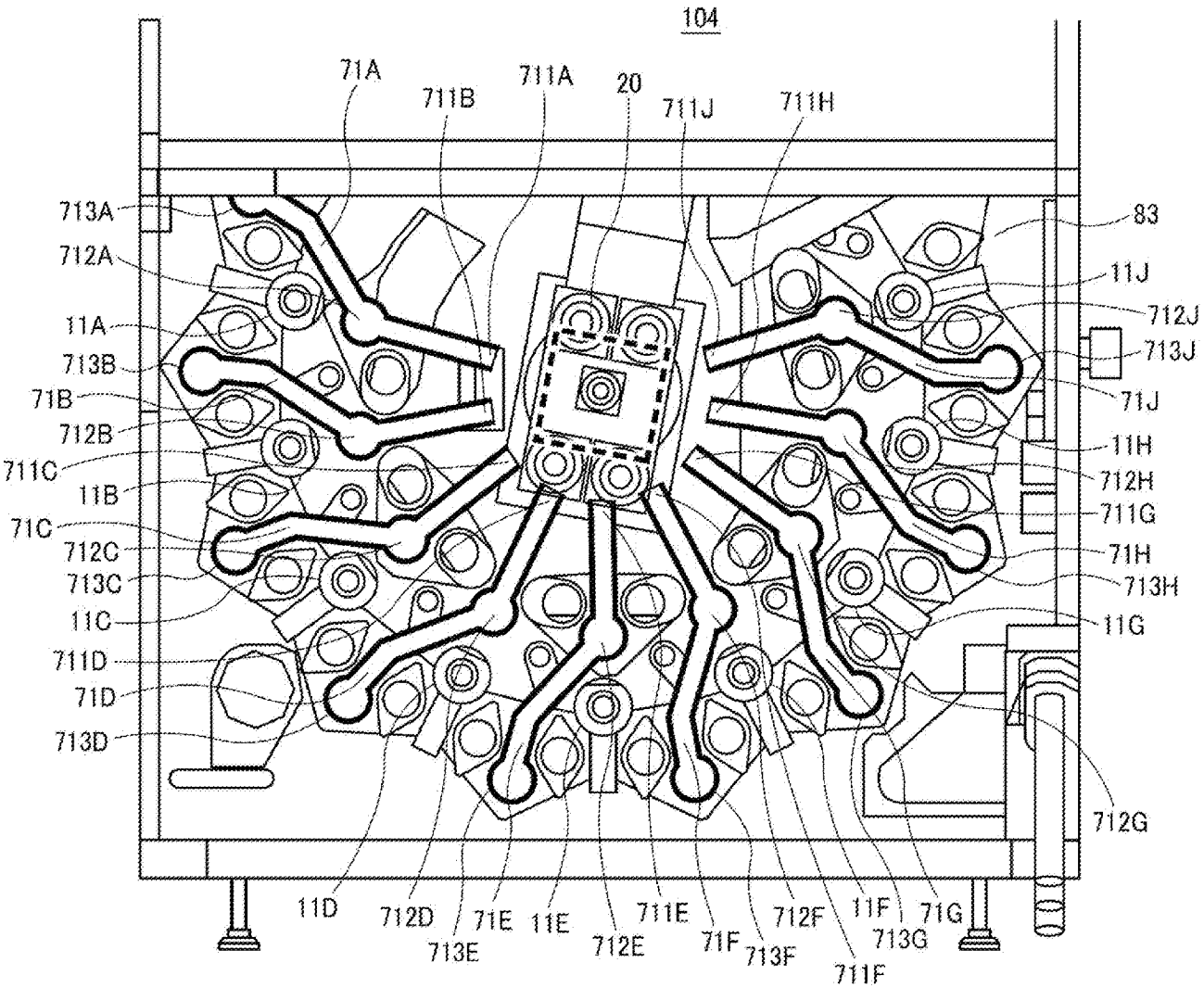
FIG. 9 is a schematic cross-sectional view of a duct in the dryer in FIGS. 2 and 3.

FIG. 9 is a schematic cross-sectional view of the duct 71 in the dryer 104 in FIGS. 2 and 3. FIG. 9 illustrates a state in which the housing 85 of the dryer 104 is removed from the dryer 104. The dryer 104 includes a fan 20 and a plurality of ducts 71A to 71J outside the rear-side plate 83.

The plurality of ducts 71A to 71J respectively includes suction ports 711A to 711J, second air-supply ports 712A to 712J, and air supply ports 713A to 713J. The suction ports 711A to 711J takes in air fed from the fan 20 toward the drum flange 12*f*. The second air-supply ports 712A to 712J are connected to the second air-supply units 21A to 21J. The air supply ports 713A to 713J are connected to the air supply units 31A to 31J. The suction ports 711A to 711J are arranged closer to the heating drum 12 than the air supply units 31A to 31J. The air supply units 31L to 31Q illustrated in FIG. 3 are configured similarly to the air supply units 31A to 31J.

Thus, the dryer 104 includes a plurality of ducts 71A to 71J, a plurality of air supply units 31A to 31J, and a plurality of second air-supply ports 712A to 71J.

The plurality of ducts 71A to 71J is connected to the air supply units 31A to 31K that feed air toward the liquid application surface of the continuous sheet 110 disposed upstream of the heating drum 12 in the conveyance direction of the continuous sheet 110. The dryer 104 according to the present embodiment may also include the plurality of ducts 71A to 71J connected to the air supply units 31L to 31Q that feed air toward the liquid application surface of the continuous sheet 110 disposed downstream of the heating drum 12 in the conveyance direction of the continuous sheet 110.

Thus, the dryer 104 can blow warm air around the drum flange 12*f* to a plurality of portions of the continuous sheet 110 positioned upstream or downstream of the heating drum 12 in the conveyance direction of the continuous sheet 110. Thus, drying efficiency of the dryer 104 is further improved.

Further, the second air-supply unit 21A to 21J can blow warm air around the drum flange 12*f* to a plurality of portions of the continuous sheet 110 that contacts the heating drum 12. Thus, drying efficiency of the dryer 104 is further improved.

The plurality of ducts 71A to 71J is arranged radially around the fan 20 in FIG. 9 that corresponds to a configuration in which the plurality of air supply units 31A to 31K surrounds the heating drum 12 in FIGS. 2 and 3.

Thus, the distances from the suction ports 711A to 711J to the air supply ports 713A to 713J in the plurality of ducts 71A to 71J becomes substantially the same. The temperature of the air fed from the plurality of air supply units 31A to 31K can be made substantially the same. Thus, the dryer 104 can reduce unevenness of drying at a plurality portions of the continuous sheet 110 positioned upstream or downstream of the heating drum 12 in the conveyance direction of the continuous sheet 110.

Further, the air supply units 31A to 31J are arranged downstream of the second air-supply units 21A to 21J in a direction of the airflow. Portions of the duct 71 between the second air-supply units 21A to 21J and the air supply units 31A to 31J are arranged close to the heating rollers 11A to 11J, respectively.

Thus, the dryer 104 can prevent temperature drop of the air fed from the air supply units 31A to 31J. Thus, the dryer 104 can improve drying of the continuous sheet 110 positioned upstream or downstream of the heating drum 12 in the conveyance direction of the continuous sheet 110.

The above-described embodiments describe examples of the object to be dried and the object to be printed using the continuous sheet 110. For example, a recording medium (printed object), such as wallpaper or an electronic circuit board sheet (e.g., prepreg), may be used in addition to a continuous material, such as a continuous sheet, a roll sheet, and a web, and a recording medium (a printed object) such as an elongated sheet material.

The printer may print recording images such as characters and figures with a liquid such as ink on a printing object. Further, the printer may print an arbitrary image such as a pattern on the printing object for purposes such as decoration.

Herein, the liquid to be applied is not particularly limited, but it is preferable that the liquid has a viscosity of less than or equal to 30 mPa·s under a normal temperature and a normal pressure or by being heated or cooled.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

When a liquid discharge head is used as the liquid applicator, examples of an energy generation source to discharge a liquid include an energy generation source using a piezoelectric actuator (a lamination piezoelectric element and a thin-film piezoelectric element), a thermal actuator using an electrothermal transducer element such as a heating resistor, a static actuator including a diaphragm plate and opposed electrodes, and the like.

The terms "printing" in the present embodiment may be used synonymously with the terms of "image formation", "recording", "printing", and "image printing".

Figure 10:
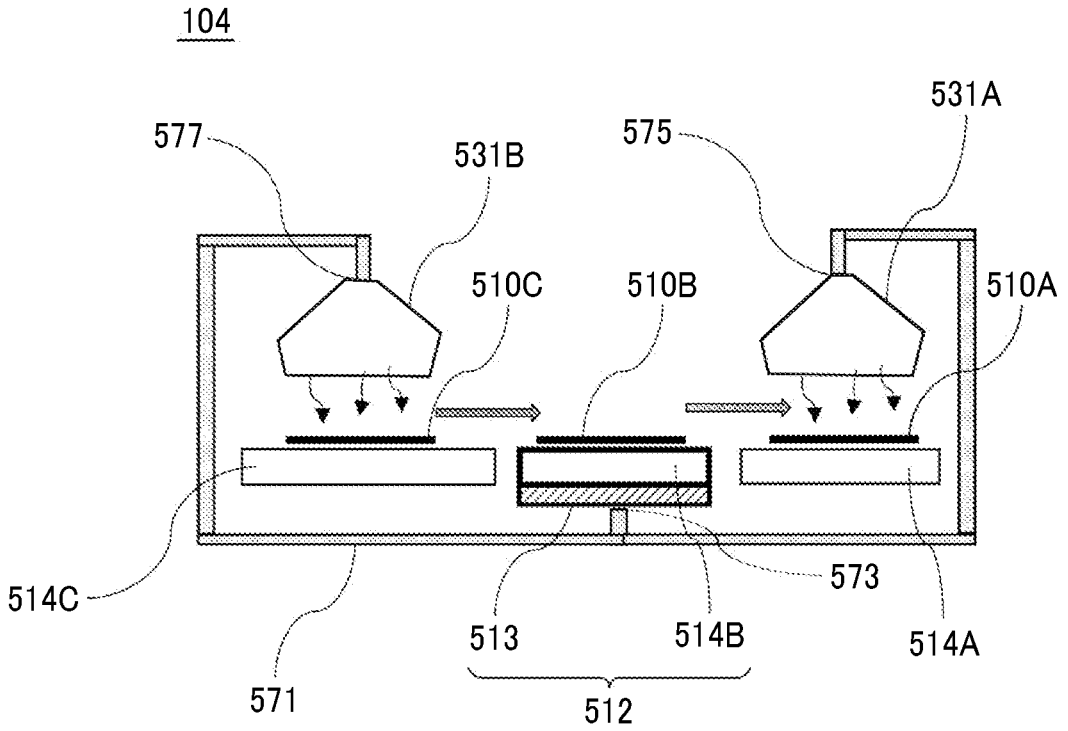

FIG. 10 is a schematic cross-sectional view of a second variation of the dryer 104 in FIG. 2.

The dryer 104 illustrated in FIG. 10 includes a heater 512, a downstream air-supply unit 531A, an upstream air-supply unit 531B, and a duct 571. The heater 512 directly faces and contacts the object to be dried and heats the object to be dried. The downstream air-supply unit 531A feeds air toward the object to be dried positioned downstream of the heater 512 in the conveyance direction of the object to be dried as indicated by arrow directed to right hand side in FIG. 10.

The upstream air-supply unit 531B feeds air toward the object to be dried positioned upstream of the heater 512 in the conveyance direction. The duct 571 feed the warm air around the heater 512 to the downstream air-supply unit 531A and the upstream air-supply unit 531B.

The heater 512 includes a platen 514B and a heater 513. An object to be dried is placed on the platen 514B. The heater 513 heats the object to be dried conveyed on the platen 514B via the platen 514B.

The duct 571 includes an intake port 573, a downstream air-supply port 575, an upstream air-supply port 577. The intake port 573 takes in air around the heater 513 and the platen 514B. The downstream air-supply port 575 is connected to the downstream air-supply unit 531A. The upstream air-supply port 577 is connected to the upstream air-supply unit 531B. The duct 571 distributes the air taken in from the intake port 573 to the downstream air-supply unit 531A and the upstream air-supply unit 531.

The intake port 573 is disposed closer to the heater 512 than the downstream air-supply unit 531A and the upstream air-supply unit 531B.

The dryer 104 includes a platen 514A and a platen 514C on which the objects to be conveyed are placed. The platen 514A and the platen 514C are arranged at positions facing the downstream air-supply unit 531A and the upstream air-supply unit 531B, respectively. The downstream air-supply unit 531A feeds air toward the object to be dried conveyed on the platen 514A. The upstream air-supply unit 531B feeds air toward the object to be dried conveyed on the platen 514C.

In the present variation, the objects to be dried are a plurality of cut sheets 510A, 510B, and 510C onto which a liquid is applied by the liquid application unit 101 and are sequentially conveyed. FIG. 10 illustrates a state in which the cut sheet 510A is placed on the platen 514A, the cut sheet 510B is placed on the platen 514B, and the cut sheet 510C is placed on the platen 514C.

One conveyed cut sheet is heated by the warm air fed from the upstream air-supply unit 531B at a position of the cut sheet 510C on the platen 514C. The one conveyed cut sheet is heated by the heater 513 via the platen 514B at the position of the cut sheet 510B. Then, the one conveyed cut sheet is heated by the warm air fed from the downstream air-supply unit 531A at the position of the cut sheet 510A.

Figure 11:
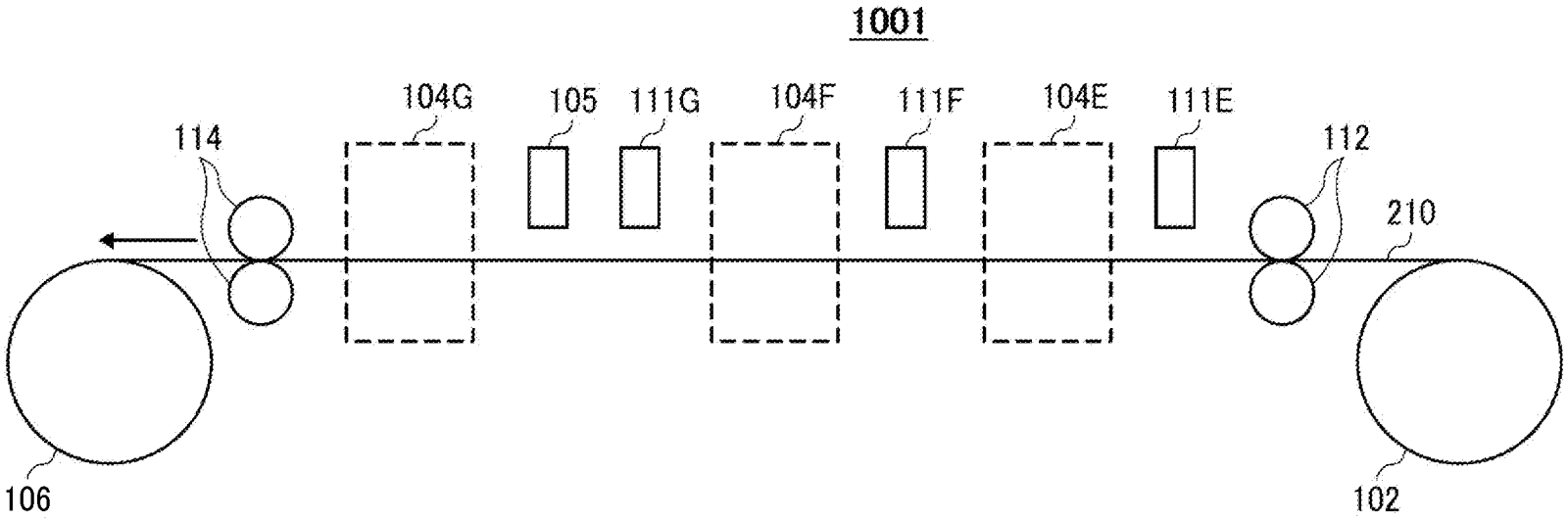
FIG. 11 is a side view of a layer forming apparatus as an example of using the dryer illustrated in FIGS. 2, 3 and 10 in the layer forming apparatus.

FIG. 11 is a side view of a layer forming apparatus as an example of using the dryer 104 illustrated in FIGS. 2, 3 and 7 in the layer forming apparatus. An electrode printing apparatus 1001 illustrated in FIG. 11 is an example of a layer forming apparatus. The electrode printing apparatus 1001 includes a root winding roller 102, a conveyance roller 112, an ejection roller 114, and a winding roller 106 as similarly in the printer 1 of FIG. 1. The electrode printing apparatus 1001 feeds an electrode substrate 210 from the root winding roller 102.

The electrode printing apparatus 1001 includes a first liquid discharge head 111E, a first dryer 104E, a second liquid discharge head 111F, a second dryer 104F, a third liquid discharge head 111G, a light source 105, and a third dryer 104G. The first liquid discharge head 111E, the first dryer 104E, the second liquid discharge head 111F, the second dryer 104F, the third liquid discharge head 111G, the light source 105, and the third dryer 104G are disposed between the conveyance roller 112 and the ejection roller 114 in an order from upstream to downstream in the conveyance direction of the electrode substrate 210. The first liquid discharge head 111E, the second liquid discharge head 111F, and the third liquid discharge head 111G are examples of a liquid application unit.

The first liquid discharge head 111E functions as a liquid discharge head for preparing an active material layer. The first liquid discharge head 111E discharges an active-material layer preparation ink that contains active material onto a surface of the electrode substrate 210 to form (prepare) the active material layer on the surface of the electrode substrate 210.

The first dryer 104E dries the electrode substrate 210 onto which the active-material layer preparation ink is applied by the first liquid discharge head 111E as an object to be dried.

The second liquid discharge head 111F functions as a liquid discharge head for forming an ink layer. The second liquid discharge head 111F discharges a liquid ink that is an inorganic layer preparation ink onto the electrode substrate 210 to form an ink layer on the electrode substrate 210.

The first dryer 104E dries the electrode substrate 210 onto which the inorganic-layer preparation ink is applied on the active material layer by the second liquid discharge head 111F as an object to be dried.

The third liquid discharge head 111G functions as a liquid discharge head for forming an ink layer. The third liquid discharge head 111G discharges a liquid ink that is a resin layer preparation ink onto the electrode substrate 210 to form the ink layer.

The light source 105 has a curing function that irradiates the ink layer formed on the electrode substrate 210 with light such as ultraviolet rays to cure the ink layer into a resin layer.

The third dryer 104G dries the electrode substrate 210 as an object to be dried. The resin layer preparation ink is applied onto the active material layer and the inorganic layer on the electrode substrate 210 by the third liquid discharge head 111G. Further, the light source 105 irradiates the resin layer preparation ink with the light. Thus, the third dryer 104G dries the resin layer preparation ink applied by the third liquid discharge head 111G and irradiated with light by the light source 105.

The third dryer 104G also has a curing acceleration function to accelerate curing of the ink layer into the resin layer. The third dryer 104G heats the ink layer formed by the resin layer preparation ink applied by the third liquid discharge head 111G to accelerate curing.

The first dryer 104E, the second dryer 104F, and the third dryer 104G have the same configuration as the configuration of the dryer 104 as illustrated in FIGS. 2 to 7. Since the first dryer 104E, the second dryer 104F, and the third dryer 104G are used in a layer forming apparatus to form a plurality of layers on the electrode substrate 210, a curvature of a conveyance path to convey the electrode substrate 210 is preferably as small as possible.

Figure 12A:
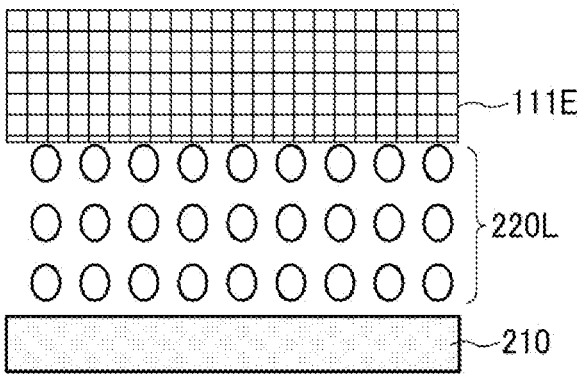
FIGS. 12A to 12C are schematic cross-sectional view of layers formed by a layer forming process of the layer forming apparatus illustrated in FIG. 11.
Figure 12B:
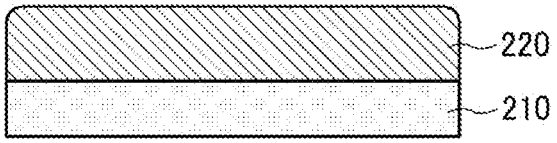
Figure 12C:
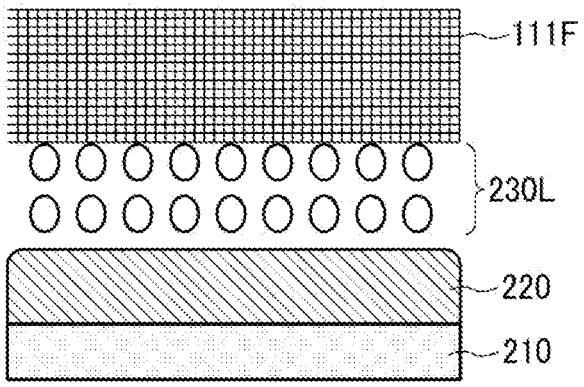
Figure 13A:
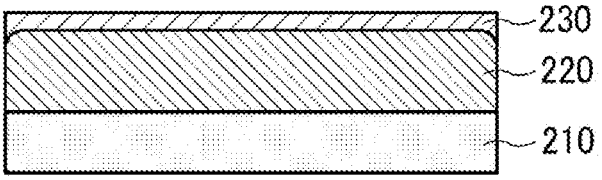
FIGS. 13A to 13C are schematic cross-sectional view of layers formed by a layer forming process of the layer forming apparatus continued from FIGS. 12A to 12C.
Figure 13B:
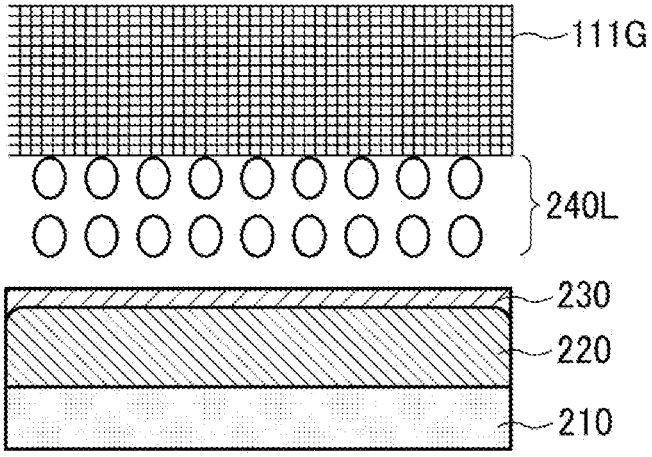
Figure 13C:
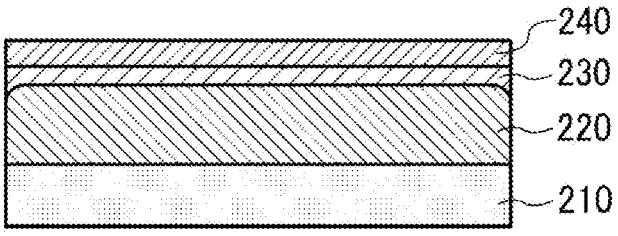

FIGS. 12A to 12C are schematic cross-sectional view of layers formed by a layer forming process of the layer forming apparatus (electrode printing apparatus 1001) illustrated in FIG. 11. FIGS. 13A to 13C are schematic cross-sectional view of layers formed by a layer forming process of the layer forming apparatus (electrode printing apparatus 1001) continued from FIGS. 12A to 12C.

As illustrated in FIG. 12A, the first liquid discharge head 111E discharges the active-material layer preparation ink 220L containing the active material onto the surface of the electrode substrate 210.

As illustrated in FIG. 12B, the first dryer 104E dries the electrode substrate 210 including the active material layer 220 formed by the active-material layer preparation ink 220L as an object to be dried.

The second liquid discharge head 111F discharges the inorganic layer preparation ink 230L onto the surface of the active material layer 220 on the electrode substrate 210 as illustrated in FIG. 9C.

Further, as illustrated in FIG. 13A, the third dryer 104G dries the electrode substrate 210 including the inorganic layer 230 formed of the inorganic layer preparation ink 230L, the inorganic layer 230, and the active material layer 220 as an object to be dried.

As illustrated in FIG. 13B, the third liquid discharge head 111G discharges the resin layer preparation ink 240L onto the surface of the inorganic layer 230 on the electrode substrate 210 and the active material layer 220.

As illustrated in FIG. 13C, the light source 105 irradiates and cures the resin layer 240 formed of the resin layer preparation ink 240L.

As illustrated in FIG. 13C, the third dryer 104G heats the resin layer 240 formed of the resin layer preparation ink 240L to accelerate curing of the resin layer 240.

Further, as illustrated in FIG. 13C, the third dryer 104G dries the electrode substrate 210 including the resin layer 240 formed of the resin layer preparation ink 240L, the inorganic layer 230, and the active material layer 220 as an object to be dried.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A dryer comprising:

a heater in a conveyance area in which an object is conveyed, the heater configured to heat the object on which a liquid is applied;

a heated portion in an outer area outside the conveyance area, the heated portion connected to the heater;

a partition wall partitioning the conveyance area and the outer area;

an air supply unit in the conveyance area, the air supply unit configured to feed air to the object conveyed in the conveyance area; and a duct in the outer area, the duct connected to the air supply unit and configured to take in air around the heated portion.

2. The dryer according to claim 1, further comprising a fan configured to feed air to the heated portion, wherein the duct takes in the air around the heated portion fed from the fan.

3. The dryer according to claim 2, further comprising:

a plurality of air supply units that includes the air supply unit; and a plurality of ducts including the duct.

4. The dryer according to claim 3, wherein the plurality of ducts is radially arranged around the fan.

5. The dryer according to claim 1, further comprising:

a plurality of air supply units including the air supply unit, wherein the duct distributes the air around the heated portion to each of the plurality of air supply units.

6. The dryer according to claim 5, further comprising a plurality of ducts including the duct, wherein each of the plurality of ducts is connected to the plurality of air supply units.

7. The dryer according to claim 1, wherein the air supply unit is made of a material having a thermal conductivity of 1 W/(m·K) or less.

8. The dryer according to claim 7, wherein the air supply unit comprises:

an air supply chamber connected to the duct;

a blowout port that blows, to the object, air in the air supply chamber;

an exhaust chamber configured to collect air around the object;

a first wall of the air supply chamber, the first wall facing the object; and a second wall of the air supply chamber, the second wall partitioning the air supply chamber and the exhaust chamber, wherein each of the first wall and the second wall is made of a material having a thermal conductivity of 1 W/(m·K) or less.

9. The dryer according to claim 7, wherein the material having the thermal conductivity of 1 W/(m·K) or less includes a resin material.

10. The dryer according to claim 1, further comprising:

an exhaust duct connected to the air supply unit, the exhaust duct configured to collect air from the air supply unit and exhaust collected air outside the dryer, wherein the air supply unit comprises:

an air supply chamber connected to the duct;

a blowout port that blows, to the object, air in the air supply chamber; and an exhaust chamber configured to collect air around the object, wherein the exhaust duct exhausts the air collected to the exhaust chamber outside the dryer.

11. A printer comprising:

a liquid application unit configured to apply the liquid onto the object; and the dryer according to claim 1 configured to dry the object on which the liquid is applied by the liquid application unit.

12. The dryer according to claim 1, wherein the heated portion is connected to the heater through the partition wall.

* * * * *